United States Patent [19]

Racek

[11] 4,430,060

[45] Feb. 7, 1984

[54] GAS LIGHTER

[76] Inventor: Alfred Racek, Seitenberggasse 54, 1160 Wien, Austria

[21] Appl. No.: 269,724

[22] Filed: Jun. 2, 1981

[51] Int. Cl.[3] ..... F23Q 1/02

[52] U.S. Cl. ..... 431/276; 431/143

[58] Field of Search ..... 431/273, 274, 276, 277, 431/130, 131, 143, 150, 151, 254

[56] References Cited

U.S. PATENT DOCUMENTS

| | | | |
|---|---|---|---|
| 2,258,085 | 10/1941 | Bolle | 431/276 |
| 2,957,328 | 10/1960 | Gellman | 431/143 X |
| 3,180,117 | 4/1965 | Lowenthal | 431/143 X |
| 3,253,430 | 5/1966 | Piffath | 431/277 |
| 3,287,939 | 11/1966 | Zellweger et al. | 431/277 X |
| 3,453,064 | 7/1969 | Goto | 431/276 X |
| 3,884,616 | 5/1975 | Neyret | 431/142 |
| 3,938,942 | 2/1976 | Torassa | 431/254 X |

FOREIGN PATENT DOCUMENTS

| | | | |
|---|---|---|---|
| 613658 | 12/1948 | United Kingdom | 431/276 |
| 749856 | 6/1956 | United Kingdom | 431/276 |

*Primary Examiner*—James C. Yeung
*Assistant Examiner*—Carl D. Price
*Attorney, Agent, or Firm*—Karl F. Ross; Herbert Dubno

[57] ABSTRACT

A lighter has a housing formed with a flame opening, a fueld supply for feeding fuel to a point at which a flame is formed in the opening, a friction wheel mounted on the housing, and a first guide formed in the housing along a radius of the wheel, a flint being provided in the first guide and being displaceable therein for engagement with the wheel adjacent the point. A second guide is formed in the housing parallel to the first guide and offset therefrom, the second guide being provided with a flint spring. A displaceable offset pushrod is provided between the flint and the spring, the pushrod having a first portion extending into the first guide and engaging the flint and a second portion extending into the second guide and engaging the spring, the first and second portions being joined by a third portion lying substantially perpendicular to the first and second portions.

2 Claims, 1 Drawing Figure

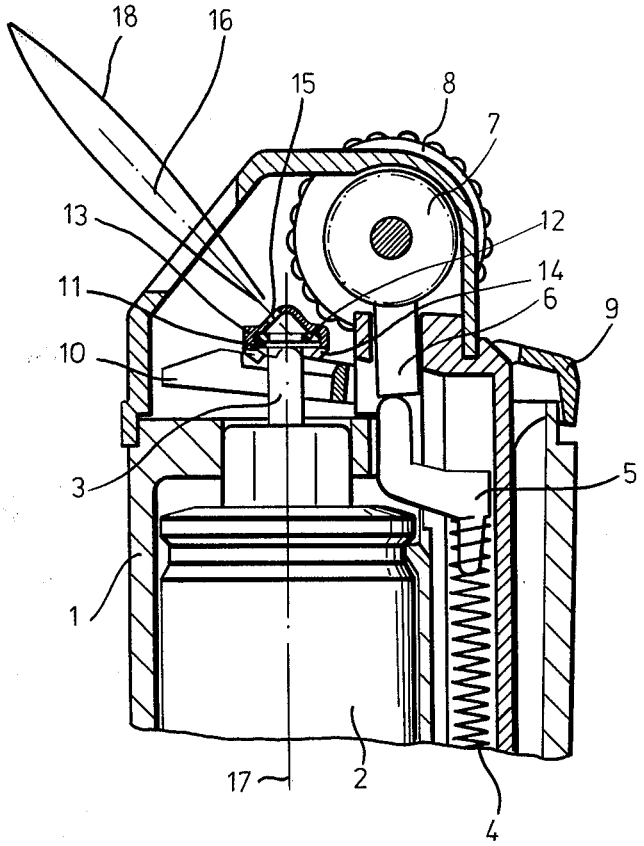
18
16
15
8
7
13
12
14
11
6
9
10
3
5
1
17
2
4

GAS LIGHTER

FIELD OF THE INVENTION

The invention relates to a gas lighter comprising a housing and a flame exit opening, the axis of which is disposed at an angle relative to the longitudinal axis of the housing where a pyrophorous ignition device is provided with a pushrod engaged by a spring and driving the flint against the friction wheel for igniting the gas exiting from an exit nozzle.

BACKGROUND OF THE INVENTION

Such gas lighters make it easier to ignite things located below the lighter, such as for example the igniting of a pipe, and it is also avoided that, especially with short lighters, the operating persons get into the heating region of the flame.

With conventional lighters of this kind the ignition of the gas is rendered more difficult based on the inclined exiting of the gas in a direction away from the wheel and flint.

OBJECT OF THE INVENTION

It is an object of the invention to avoid the mentioned disadvantage and to insure a certain ignition.

SUMMARY OF THE INVENTION

This object is achieved by providing a pushrod of Z-shape adjacent the exit nozzle. By way of this inventive provision it is possible to bring the break off point of the spark closer to the exit nozzle such that an ignition is achieved with certainty.

SPECIFIC DESCRIPTION

In the following the invention is described more clearly by way of an embodiment shown in the sole FIGURE of the drawing, however without being limited to this example. The drawing shows the upper part of the lighter according to the invention in a sectional view.

In accordance with the invention, a gas tank is disposed in a housing 1, which tank is provided at its upper end with a burner tube 3. A flint spring 4 is located at the side of the gas tank 2 in the housing 1. The spring 4 pushes, via a pushrod 5 a firestone 6 against a friction wheel 7. This friction wheel 7 is flanked by, and connected to, actuating wheels 8, which actuate the friction wheel into rotation by way of the thumb of the user and thereby sparks are broken off from the flint 6. After the rotation of the friction wheel 7, the thumb of the user is disposed on an actuating member 9, which is formed as a two arm lever and which engages with its fork-shaped end 10 the collar 11 of the burner tube 3.

A cap 13 is mounted on the end of the burner tube 3 with a seal 12 interposed. The attachment of the cap 13 to the burner tube 3 is provided by a flange 14, which is edged over the collar 11 of the cap 13. A gas exit nozzle 15 is formed in the cap 13 and the axis of the exit nozzle runs at an angle to the axis 17 of the housing 1 or respectively the gas tank 2.

It can be recognized from the drawing that the pushrod has the form of a Z-shape extending toward the burner tube 3. This allows placing the flint 6, and thereby the break off point of the sparks, closer to the exit nozzle 15, such that despite an inclined course of the exit nozzle, an assured igniting is guaranteed.

I claim:

1. A lighter comprising:

a housing having a flame opening;

a fuel supply tank in said housing for feeding fuel to a point at which a flame is formed in said opening, said tank having an axis and a nozzle means extending along said axis to said point, said opening being inclined to said axis;

a friction wheel mounted in said housing;

a first guide passage formed in said housing along a radius of said friction wheel and parallel to said axis but within an axial projection of the tank;

a flint in said guide passage and displaceable therein for the engagement of one end of said flint with the periphery of said wheel adjacent said point;

a second guide passage formed in said housing parallel to said first guide passage and said axis and offset outwardly from said first guide passage and extending alongside said tank;

a helical coil flint spring in said second guide passage; and a displaceable offset generally Z-shaped pushrod between said flint and said spring, said pushrod having a first portion extending into said first guide passage and engaging the other end of said flint and a second portion extending into said second guide passage and engaging said spring, said first and second portions being joined by a third portion lying substantially perpendicular to said first and second portions.

2. The lighter defined in claim 1, wherein said point is substantially centrally positioned at one end of said housing and said first guide lies between said point and said second guide.

* * * * *